US008650927B1

(12) United States Patent
Kim et al.

(10) Patent No.: US 8,650,927 B1
(45) Date of Patent: Feb. 18, 2014

(54) FORMING DEVICE FOR THIXOEXTRUSION AND METHOD THEREOF

(71) Applicant: Korea Institute of Industrial Technology, Chungcheongnam-do (KR)

(72) Inventors: Shea Kwang Kim, Seoul (KR); Young Ok Yoon, Incheon (KR); Dong In Jang, Incheon (KR)

(73) Assignee: Korea Institute of Industrial Technology, Chungcheongnam-do (KR)

( * ) Notice: Subject to any disclaimer, the term of this patent is extended or adjusted under 35 U.S.C. 154(b) by 0 days.

(21) Appl. No.: 14/056,112

(22) Filed: Oct. 17, 2013

Related U.S. Application Data

(62) Division of application No. 12/812,746, filed as application No. PCT/KR2008/005654 on Sep. 24, 2008, now Pat. No. 8,584,501.

(30) Foreign Application Priority Data

Jan. 14, 2008 (KR) ..... 10-2008-0003798
Mar. 26, 2008 (KR) ..... 10-2008-0027897

(51) Int. Cl.
*B21C 27/00* (2006.01)

(52) U.S. Cl.
USPC ..... 72/272; 72/253.1

(58) Field of Classification Search
USPC ..... 72/253.1, 268, 270, 272, 260, 264, 286, 72/342.1, 342.5, 342.94; 425/113, 144, 425/516
See application file for complete search history.

(56) References Cited

U.S. PATENT DOCUMENTS

| | | | | |
|---|---|---|---|---|
| 4,860,565 | A * | 8/1989 | Kato et al. | 72/38 |
| 5,167,138 | A * | 12/1992 | Sinha et al. | 72/262 |
| 6,053,997 | A | 4/2000 | Nakamura et al. | |
| 6,360,576 | B1 | 3/2002 | Plata et al. | |
| 6,637,250 | B2 | 10/2003 | Plata et al. | |
| 2002/0189313 | A1 | 12/2002 | Plata et al. | |
| 2007/0203281 | A1 | 8/2007 | Alric et al. | |

FOREIGN PATENT DOCUMENTS

| | | |
|---|---|---|
| DE | 60116740 | 9/2006 |
| EP | 1264646 | 12/2002 |
| GB | 2362848 | 12/2001 |
| JP | 45-11881 | 4/1970 |
| JP | 52-033870 | 3/1977 |
| JP | 01-309717 | 12/1989 |
| JP | 03-027813 | 2/1991 |
| JP | 04-052024 | 2/1992 |
| JP | 6-7833 | 1/1994 |
| JP | 09-085409 | 3/1997 |
| JP | 10-158772 | 6/1998 |

(Continued)

OTHER PUBLICATIONS

International Search Report mailed Mar. 31, 2009 for PCT/KR2008/005654.

(Continued)

*Primary Examiner* — Debra Sullivan

(57) ABSTRACT

According to the apparatus and method, metals can be molded under a low extrusion pressure, the life of the apparatus is prolonged, the strength of the metal products is improved, the ignition of the metals is inhibited during processing, the amount of a protective gas used is reduced, and the formation of welding lines is inhibited.

20 Claims, 12 Drawing Sheets

(56) References Cited

FOREIGN PATENT DOCUMENTS

| | | |
|---|---|---|
| JP | 2000-109963 | 4/2000 |
| JP | 2001-503678 | 3/2001 |
| JP | 2003-155547 | 5/2003 |
| JP | 2005-000993 | 1/2005 |
| JP | 2005-297062 | 10/2005 |
| JP | 2006-068749 | 3/2006 |
| KR | 10-0391760 | 7/2003 |
| KR | 2005-0022548 | 3/2005 |
| KR | 2007-0075285 | 7/2007 |
| KR | 10-0799739 | 1/2008 |

OTHER PUBLICATIONS

Written Opinion of the International Search Report mailed Mar. 31, 2009 for PCT/KR2008/005654.

* cited by examiner

Position 1. Billet [Center-F 75 mm position]

Position 2. Billet [Edge-F 75 mm position]

Position 3. Billet [Center-F 20 mm position]

Position 4. Billet [Edge-F 20 mm position]

Position 5. Billet [Center-B 20 mm position]

Position 6. Billet [Edge-B 20 mm position]

A: Maximum extrusion pressure during hot extrusion of A7003 aluminum alloy
B: Maximum extrusion pressure during hot extrusion of A7075 aluminum alloy
C: Maximum extrusion pressure during thixoextrusion of A7003 aluminum alloy
D: Maximum extrusion pressure during thixoextrusion of A7075 aluminum alloy

FORMING DEVICE FOR THIXOEXTRUSION AND METHOD THEREOF

This application is a divisional of Kim et al., U.S. patent application Ser. No. 12/812,746, filed on Aug. 16, 2010, entitled "FORMING DEVICE FOR THIXOEXTRUSION AND METHOD THEREOF", which is the National Stage application of International Application No. PCT/KR2008/005654, filed Sep. 24, 2008, and claims the priority of Korean Patent Application Nos. 10-2008-003798 and 10-2008-0027897, filed on Jan. 14, 2008 and Mar. 26, 2008 in the KIPO (Korean Intellectual Property Office), the disclosure of which is incorporated herein entirely by reference. Each of these applications is hereby incorporated by reference in their entirety into the present application.

TECHNICAL FIELD

The present invention relates to thixoextrusion molding apparatuses and methods.

BACKGROUND ART

In recent years, various attempts have been made to solve problems associated with fuel consumption and environmental pollution in the transportation industry, including automobiles, aircraft and high-speed electric trains. Under these circumstances, weight reduction has increasingly gained importance. Aluminum and magnesium are widely used at present as materials for weight reduction of transportation vehicles.

Hot extrusion is typically used to produce aluminum- and magnesium-based components and parts. Hot extrusion is very advantageous in terms of production cost because highly accurate and complex molded articles can be produced through only one thermal deformation step.

Although high-strength, diffi cult-to-process aluminum alloys, typified by A2XXX and A7XXX, Mg-AI-Zn-based alloys, high-strength Zr-based ZK60 alloys and copper-containing ZC63 alloys have higher specific strength and higher specific stiffness than other aluminum and magnesium alloys, their productivity is one fifth or one sixth of that of the other aluminum and magnesium alloys. Greatly reduced extrudability is responsible for the low productivity of the high-strength alloys. Further, the high-strength alloys drastically shorten the life of extrusion molding apparatuses due to high pressure at the initial stage of extrusion. Furthermore, the structure of molded metals produced by conventional hot extrusion processes is elongated in a predetermined direction and becomes anisotropic, resulting in low strength of the molded metals.

On the other hand, die casting and thixoextrusion molding are known to be useful for producing aluminum and magnesium alloys. According to a thixoextrusion molding process, a metal material is extrusion-molded in a temperature region where solid and liquid phases coexist. Thus, thixoextrusion molding is a new phase-change molding process that combines the inherent advantages of casting and forging processes.

However, thixoextrusion molding processes have the problem that semi-solid metals may be ignited during extrusion molding. Although protective gases are useful in inhibiting the ignition of semi-solid metals, they are harmful to humans, cause metallic equipment to corrode and have secondary problems, including global warming.

Metal bars and tubes can be produced using extrusion molding apparatuses. For example, a metal tube is produced by extruding metal in a solid state under a high pressure or using an extrusion molding apparatus having a porthole die. However, the high-pressure extrusion process involves a high loss of the raw material, and the porthole die extrusion process has a problem in that welding seams are formed.

DISCLOSURE

Technical Problem

The present invention has been made in an effort to solve the above-mentioned problems of the prior art, and it is an object of the present invention to provide a thixoextrusion molding apparatus and a thixoextrusion molding method by which a metal can be molded under a low extrusion pressure to achieve high productivity and prolonged life of the equipment.

A further object of the present invention is to provide a thixoextrusion molding apparatus and a thixoextrusion molding method by which elongation and anisotropy of a metal can be inhibited during extrusion molding to improve the strength of the metal.

Another object of the present invention is to provide a thixoextrusion molding apparatus and a thixoextrusion molding method by which the amount of a protective gas used can be reduced without being ignited during extrusion molding.

Still another object of the present invention is to provide a thixoextrusion molding apparatus and a thixoextrusion molding method by which the formation of welding lines can be inhibited to prevent destruction of a final molded article resulting from pressurization and expansion.

Technical Solution

In accordance with a first aspect of the present invention, the above and other objects can be accomplished by the provision of a thixoextrusion molding apparatus comprising: a container having a first through-hole storing 10 to 30 parts by weight of a semi-solid billet therein and a heater installed outside the first through-hole to maintain the temperature of the semi-solid billet constant; a stem insertable into the first through-hole from the front of the container to pressurize the semi-solid billet in the backward direction; a die ring coupled to the back of the container and having a plurality of coolant inflow/outflow holes to prevent thermal deformation in the circumferential direction; a die body disposed inside the die ring and having a second through-hole, which is in communication with the first through-hole of the container and has a smaller diameter than the first through-hole of the container, through which the semi-solid billet is extruded and a plurality of thermocouple insertion holes for measuring the temperature of the semi-solid billet; a die body support coupled to the back of the die body inside the die ring and having a plurality of coolant inflow/outflow holes so as to change the phase of the extruded semi-solid billet to a solid extrudate; a die balance support held in close contact with the die body support and coupled to the back of the die ring; and a cooling unit coupled to the die balance support to cool the solid extrudate.

In an embodiment, the thermocouple insertion holes may include a first thermocouple insertion hole for measuring the temperature of the die body and a second thermocouple insertion hole for measuring the temperature of the semi-solid billet.

In an embodiment, the semi-solid billet may be selected from aluminum alloys and magnesium alloys.

In an embodiment, the semi-solid billet may be a magnesium alloy containing at least one additive.

In an embodiment, the additive may be selected from alkali metals, alkali metal oxides, alkali metal compounds, alkaline earth metals, alkaline earth metal oxides, alkaline earth metal compounds, and mixtures thereof.

In an embodiment, the additive may be present in an amount of 0.0001 to 30 parts by weight, based on 100 parts by weight of the magnesium alloy.

In an embodiment, the semi-solid billet may be maintained at a temperature of 590 to 650° C. by the heater of the container.

In accordance with a second aspect of the present invention, there is provided a thixoextrusion molding apparatus comprising: a container storing 10 to 30 parts by weight of a semi-solid billet therein; an extrusion die having a plurality of extrusion holes through which the semi-solid billet is split and extruded into a plurality of strands, a bearing in communication with a chamber accommodating the semi-solid billet passing through the extrusion holes, and a mandrel positioned at the central axis of the bearing; a heater for maintaining the temperature of the semisolid billet stored in the container constant; a temperature sensor detecting the temperature of the semi-solid billet heated by the heater inside the container; and a control unit comparing the temperature value detected by the temperature sensor with a preset value to control the on/off operation of the heater.

In an embodiment, the semi-solid billet may be selected from aluminum alloys and magnesium alloys.

In an embodiment, the semi-solid billet may be a magnesium alloy containing at least one additive.

In an embodiment, the additive may be selected from alkali metals, alkali metal oxides, alkali metal compounds, alkaline earth metals, alkaline earth metal oxides, alkaline earth metal compounds, and mixtures thereof.

In an embodiment, the additive may be present in an amount of 0.0001 to 30 parts by weight, based on 100 parts by weight of the magnesium alloy.

In an embodiment, the semi-solid billet may be maintained at a temperature of 590 to 650° C. by the heater of the container.

In accordance with a third aspect of the present invention, there is provided a thixoextrusion molding method using the apparatus according to the first aspect, the method comprising: maintaining 10 to 30 parts by weight of a semi-solid billet in the container at a constant temperature; maintaining the temperature of the die body constant; extrusion-molding the semi-solid billet into a solid extrudate under pressure in the die body; and cooling the solid extrudate.

In an embodiment, the semi-solid billet may be selected from aluminum alloys and magnesium alloys.

In an embodiment, the semi-solid billet may be a magnesium alloy containing at least one additive.

In an embodiment, the additive may be selected from alkali metals, alkali metal oxides, alkali metal compounds, alkaline earth metals, alkaline earth metal oxides, alkaline earth metal compounds, and mixtures thereof.

In an embodiment, the additive may be present in an amount of 0.0001 to 30 parts by weight, based on 100 parts by weight of the magnesium alloy.

In an embodiment, the semi-solid billet may be maintained at a temperature of 590 to 650° C. by the heater of the container.

In accordance with a fourth aspect of the present invention, there is provided a thixoextrusion molding method using the apparatus according to the second aspect, the method comprising: heating a semi-solid billet stored in the container by the heater to maintain the temperature of the semi-solid billet constant; detecting the temperature of the semi-solid billet heated by the heater inside the container using the temperature sensor; and comparing the temperature value detected by the temperature sensor with a preset value to control the on/off operation of the heater using the control unit.

Advantageous Effects

The thixoextrusion molding apparatuses and methods of the present invention have the following advantageous effects.

A semi-solid billet is maintained at a constant temperature in the solid-liquid coexisting region before extrusion molding, thus enabling the production of a solid extrudate in the form of a bar or tube under a low pressure.

Further, the extrusion pressure can be markedly reduced at the initial stage of extrusion, resulting in an increase in the life of the extrusion molding apparatuses.

Further, no elongation and axial symmetry of grains in the extrusion direction occur, resulting in an improvement in the mechanical strength of an extrudate.

Further, a small amount of an additive can be added to a metal alloy to inhibit ignition during extrusion molding and reduce the amount of a protective gas used.

Further, a semi-solid metal escaping from the extrusion holes passes through the bearing and the mandrel and is fused without any seam, so that an extrudate in the form of a tube is protected from being destroyed during expansion or pressure resistance testing.

BEST MODE

Figure 1:
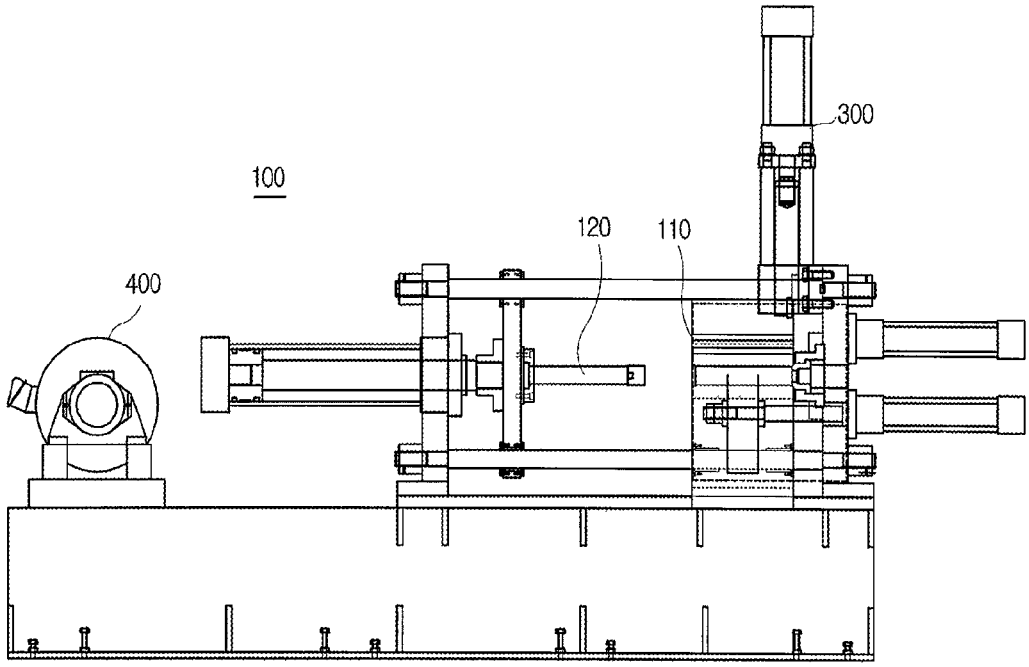
FIG. 1 is a schematic side view illustrating a thixoextrusion molding apparatus according to an embodiment of the present invention.

Preferred embodiments of the present invention will now be described in detail with reference to the accompanying drawings, such that those skilled in the art can easily practice the present invention.

No particular limitation is imposed on the kind of the metal used in the present invention. For example, the metal is selected from A7003 aluminum alloys, A7075 aluminum alloys, and equivalents thereof.

The A7003 aluminum alloys essentially consist of magnesium (Mg) and zinc (Zn) and contain 0.2% by weight of copper (Cu), 0.3% by weight of silicon (Si), 0.35% by weight of iron (Fe), 0.3% by weight of manganese (Mn) and the balance of inevitable impurities. The A7003 aluminum alloys are widely used in the production of high-strength wheels for automotive vehicles.

The A7075 aluminum alloys essentially consist of magnesium (Mg) and zinc (Zn) and contain 2.0% by weight of copper (Cu), 0.4% by weight of silicon (Si), 0.5% by weight of iron (Fe), 0.3% by weight of manganese (Mn) and the balance of inevitable impurities. The A7075 aluminum alloys are widely used as high-strength structural materials for aircraft applications.

The A7003 and A7075 aluminum alloys are merely illustrative, and other kinds of aluminum alloys, magnesium alloys, copper alloys, ceramic-based composite materials and low-quality recycled materials are available in the present invention.

For example, magnesium alloys, such as AZ91 D, AM20, AM30, AM50, AM60, AZ31, Mg—Al, Mg—Al—Re, Mg—Al—Sn, Mg—Zn—Sn, Mg—Si, SiCp/Mg and Mg—Zn—Y, as well as pure magnesium can be used in the present invention.

An additive may be added to increase the ignition temperature of the magnesium alloy and prevent the oxidation of the magnesium alloy. The additive may be selected from an alkali metal, an alkali metal oxide, an alkali metal compound, an alkaline earth metal, an alkaline earth metal oxide, an alkaline earth metal compound, and equivalents thereof. These additives may be used alone or as a mixture of two or more thereof.

The alkali metal oxide may be selected from sodium oxide, potassium oxide, and equivalents thereof. These alkali metal oxides may be used alone or as a mixture thereof. The alkaline earth metal oxide may be selected from beryllium oxide, magnesium oxide, calcium oxide, strontium oxide, and equivalents thereof. These alkaline earth metal oxides may be used alone or as a mixture of two or more thereof. The alkaline earth metal compound may be selected from calcium carbide ($CaC_2$), calcium cyanamide ($CaCN_2$), calcium carbonate ($CaCO_3$), calcium sulfate hemihydrate ($CaSO_4$), and equivalents thereof. These alkaline earth metal compounds may be used alone or as a mixture of two or more thereof. However, there is no restriction on the kinds of the alkali metal oxide, the alkaline earth metal oxide and the alkaline earth metal compound. That is, any material may be used as the additive so long as it can increase the ignition temperature of the magnesium alloy, reduce the oxidation of the magnesium alloy or decrease the required amount of a protective gas.

The additive can be added in an amount of 0.0001 to 30 parts by weight, based on 100 parts by weight of the magnesium alloy. If the amount of the additive added is less than 0.0001 parts by weight, the intended effects (i.e. increased ignition temperature, reduced oxidation and decreased amount of the protective gas) of the additive are negligible. Meanwhile, if the amount of the additive added is more than 30 parts by weight, the inherent characteristics of the magnesium or magnesium alloy are not exhibited.

The additive may have a size of 1 to 500 μm. It is practically difficult and economically undesirable to prepare the additive in a size smaller than 1 μm. Meanwhile, the additive larger than 500 μm may not be miscible with the molten magnesium.

10 to 30 parts by weight of a semi-solid billet is fed into one of the extrusion molding apparatuses of the present invention. The use of the semi-solid billet in an amount of less than 10 parts by weight necessitates a relatively high pressure to greatly shorten the life of the extrusion molding apparatus. That is, the expected advantages of thixoextrusion over hot extrusion cannot be attained. On the other hand, it is difficult to feed the semi-solid billet in an amount of more than 30 parts by weight into the extrusion molding apparatus because the semi-solid billet is substantially a liquid. That is, the use of the semi-solid billet in an amount within the range defined above enables the production of an extrudate under a low pressure and makes it easy to handle.

Figure 2:
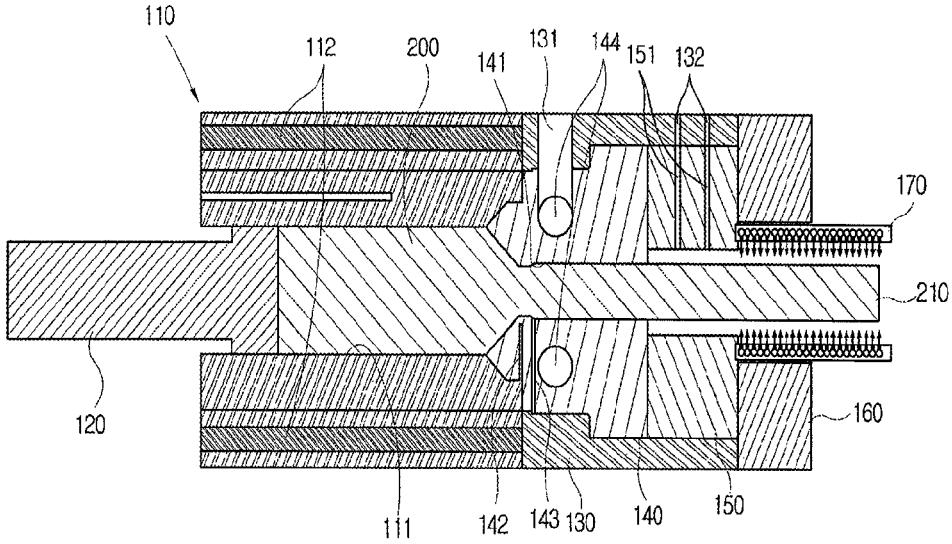
FIG. 2 is an enlarged cross-sectional view illustrating some parts (including a container) of the apparatus of FIG. 1.
Figure 3:
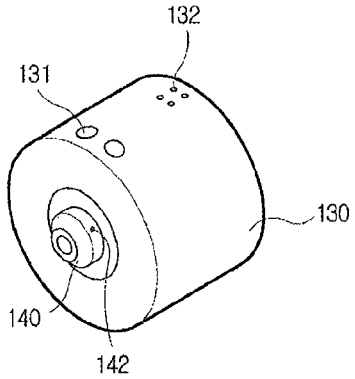
FIG. 3 is a perspective view illustrating an assembled state of some parts (a die ring and a die body) of the apparatus of FIG. 1.
Figure 4:
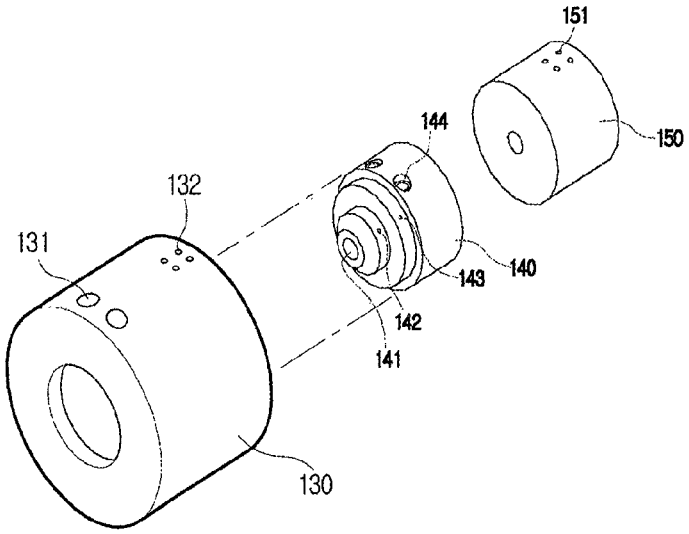
FIG. 4 is a perspective view illustrating a disassembled state of some parts (a die ring, a die body and a die body support) of the apparatus of FIG. 1.

FIG. 1 is a schematic side view illustrating a thixoextrusion molding apparatus 100 according to an embodiment of the present invention, FIG. 2 is an enlarged cross-sectional view illustrating some parts of the apparatus 100, FIG. 3 is a perspective view illustrating an assembled state of some parts of the apparatus 100, and FIG. 4 is a perspective view illustrating a disassembled state of some parts of the apparatus 100.

As illustrated in FIGS. 1 through 4, the thixoextrusion molding apparatus 100 comprises: a container 110 having a first hollow through-hole 111 and a heater 112 installed therein to form an appearance of the apparatus 100; a stem 120 insertable into the first through-hole 111 of the container 110 to pressurize an extrusion billet 200 in a semi-solid state from the front of the container 110; a die body 140 coupled to the back of the container 110 and having a second hollow through-hole 141 whose diameter is smaller than that of the first through-hole 111 of the container 110; a die body support 150 positioned at the rear of the die body 140 to prevent thermal deformation of the die body 140 in the lengthwise direction; a die balance support 160 coupled to the back of the die body support 150, a die ring 130 surrounding the die body 140 and the die body support 150 to prevent thermal deformation of the die body 140 in the circumferential direction; and a cooling unit 170 coupled to the back of the die body support 150 to cool a high-temperature solid extrudate 210 extruded from the semi-solid extrusion billet 200.

Reference numeral 300 denotes a cutting device for cutting the semi-solid extrusion billet 200 and the solid extrudate 210, and reference numeral 400 is a driving device for operating the extrusion molding apparatus 100.

In more detail, a first thermocouple insertion hole 142 is formed at the outer circumference of the die body 140 to measure the temperature of the die body 140, a second thermocouple insertion hole 143 is formed deep from the outer circumference of the die body 140 to measure the temperature of the extrudate 210, and first inflow/outflow holes 144 through which a circulating fluid (e.g., oil or cooling water) flows are formed at the outer circumference of the die body 140 to prevent an increase in the temperature of the die body 140 while maintaining the temperature constant.

At the outer circumference of the die ring 130, second inflow/outflow holes 131 penetrating the die ring 130 are formed so as to be in communication with the first inflow/outflow holes 144 of the die body 140, and third inflow/outflow holes 132 are formed through which a gas or cooling water flows to prevent the oxidation of the extrudate 210 passing through the die body 140 or to cool the extrudate 210.

Fourth inflow/outflow holes 151 penetrating the outer circumference of the die body support 150 are formed so as to be in communication with the third inflow/outflow holes 132 to allow the gas or cooling water to flow therethrough.

Hereinafter, the production procedure of the solid extrudate 210 in the extrusion molding apparatus 100 will be explained. First, a semi-solid extrusion billet is fed into the container 110 and heated to the solid-liquid coexisting region by the heater 112. Alternatively, the semi-solid extrusion billet may be heated to the solid-liquid coexisting region before being fed into the container 110 whose temperature is maintained constant in the solid-liquid coexisting region. Then, the semi-solid extrusion billet is pressurized using the stem 120.

At this time, the die body 140 is constructed such that the temperature of the extrusion billet can be maintained during extrusion therein. This construction of the die body 140 prevents an increase in the surface temperature of the die body 140 and the solid extrudate 210 resulting from the friction between the semi-solid extrusion billet and the die body 140 during extrusion. As a result, a deterioration in the quality of the solid extrudate 210 is prevented.

Particularly, if the temperature of the semi-solid extrusion billet heated to the solid-liquid coexisting region (where solid and liquid phases coexist by heating) is not accurately controlled, the grains of the material are not uniform in size and centerline segregation and liquid segregation occur during molding due to a non-uniform solid fraction in cross section, making it impossible to attain uniform mechanical properties.

The cooling unit 170 serves to prevent the formation of coarse solid particles in the solid extrudate 210 passing through the die body 140.

Figure 5:
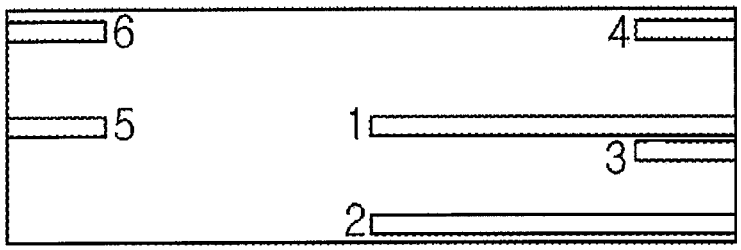
FIG. 5 illustrates installation positions of thermocouples for measuring the temperatures of an extrudate at different positions in the apparatus of FIG. 1.

FIG. 5 shows installation positions of thermocouples for measuring the temperatures of the extrudate at different positions in the thixoextrusion molding apparatus. More specifically, the thermocouples are positioned to measure the temperatures of an A7003 aluminum extrusion billet at different positions during reheating. The temperature measurements at different positions are conducted to confirm the temperature distribution over the entire region of the extrusion billet. For accurate temperature control, the temperatures of the extrusion billet at different positions are directly measured by the thermocouples as a function of heating time and variations in the measured temperatures are evaluated.

Figure 6:
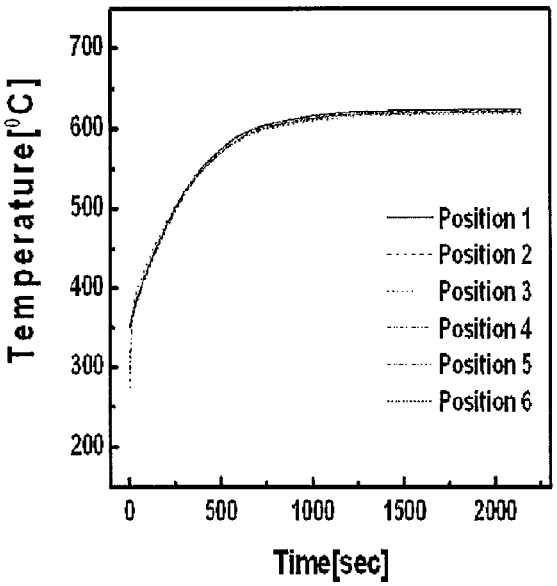
FIG. 6 is a graph showing variations in the temperature of an extrudate at different positions in the apparatus of FIG. 1 as a function of time.

FIG. 6 is a graph showing variations in the temperature of the extrudate at the different positions in the thixoextrusion molding apparatus as a function of time.

As shown in FIG. 6, there are slight differences in the temperatures of the semi-solid extrusion billet at the respective positions at the initial stage of reheating. After the temperatures of the semi-solid extrusion billet at the respective positions reach the solid-liquid coexisting region (ca. 620° C.), the semi-solid extrusion billet is maintained as a whole at a substantially constant temperature.

Figure 7:
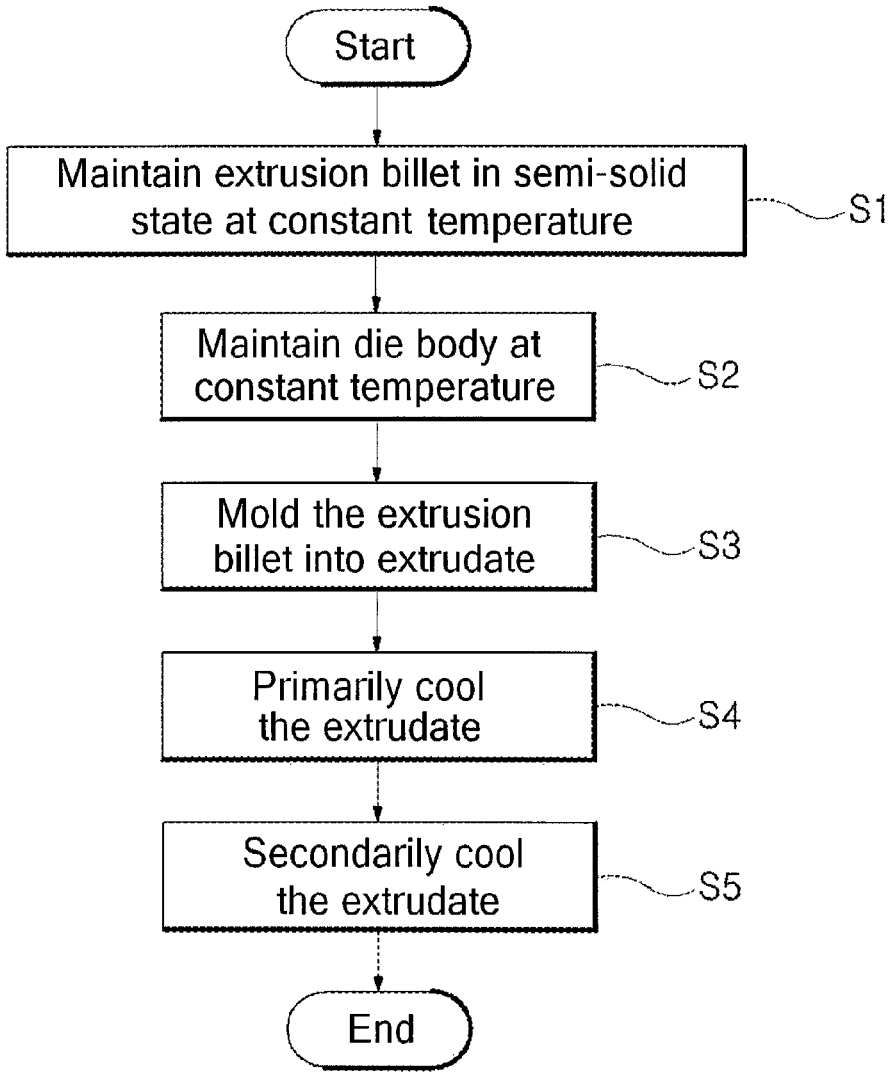
FIG. 7 is a flow chart illustrating a thixoextrusion molding method of the present invention.

FIG. 7 is a flow chart illustrating a thixoextrusion molding method of the present invention.

As shown in FIG. 7, the method of the present invention comprises maintaining an extrusion billet 200 in a semi-solid state at a constant temperature (S1), maintaining the temperature of the die body constant (S2), molding the extrusion billet into an extrudate (S3), primarily cooling the extrudate (S4), and secondarily cooling the extrudate (S5).

In step S1, the extrusion billet 200 is fed into the container 110 of the thixoextrusion molding apparatus and is heated to a temperature of 590 to 650° C. by the heater 112. This heating maintains the extrusion billet 200 in a semi-solid state, where solid and liquid phases coexist, at a constant temperature. Alternatively, the extrusion billet 200 may be heated to the solid-liquid coexisting region outside the apparatus before being fed into the container 110 whose temperature is maintained constant in the solid-liquid coexisting region. In the case where the constituent semi-solid metal of the extrusion billet 200 contains at least one of the additives mentioned above, oxidation and ignition of the extrusion billet 200 in a semi-solid state, where solid and liquid phases coexist, are more effectively inhibited.

When the extrusion billet 200 is maintained in a semi-solid state, where solid and liquid phases coexist, in the container 110, a protective gas (e.g., $SF_6$) may be used to prevent the extrusion billet 200 from being ignited. In the case where the additive is present in the constituent semi-solid metal of the extrusion billet 200 to increase the ignition temperature of the extrusion billet 200, the temperature of the extrusion billet 200 can be maintained constant using the protective gas in a reduced amount or without the use of the protective gas.

In step S2, the temperature of the die body 140 is measured using thermocouples and a circulating fluid (e.g., oil or cooling water) is allowed to flow in response to the measured temperature to maintain the temperature of the die body at a temperature of 590 to 650° C. The flow of the circulating fluid prevents an increase in the temperature of the die body 140 while maintaining the temperature constant.

In step S3, the extrusion billet 200 in a semi-solid state, where solid and liquid phases coexist, in the container 110 is extruded under pressure by the step 120 within the die body 140 to be molded into a solid extrudate 210. Since the extrusion billet 200 is in a semi-solid state, where solid and liquid phases coexist, a low pressure can be used to mold the extrusion billet 200 into the solid extrudate 210. This improved extrudability of the extrusion billet 200 not only leads to an improvement in productivity, but also enables the production of a complex molded component with accurate dimensions.

When the extrusion billet 200 is extruded under pressure to be molded into the solid extrudate 210, a protective gas (e.g., $SF_6$) may be used to prevent the extrusion billet 200 from being ignited. In the case where the additive is present in the constituent semi-solid metal of the extrusion billet 200 to increase the ignition temperature of the extrusion billet 200, the extrusion billet 200 may be extruded under pressure using the protective gas in a reduced amount or without the use of the protective gas. Further, the presence of the additive in the constituent semisolid metal of the extrusion billet 200 allows the extrudate 210 to have a more isotropic structure with grain refinement.

In step S4, a cooling gas or water flows through the third and fourth inflow/outflow holes 132 and 151 to prevent the extrudate 210 produced by extrusion molding in the die body 140 from oxidation and to primarily cool the extrudate 210. Friction may occur between the extrudate 210 and the die body 140 during extrusion molding to increase the surface temperature of the extrudate 210. This increase in surface temperature results in oxidation of the extrudate 210, eventually leading to a deterioration in quality. Particularly, if the temperature of the semi-solid extrusion billet 200 heated to the solid-liquid coexisting region, where solid and liquid phases coexist by heating, is not accurately controlled, the grains of the material are not uniform in size and centerline segregation and liquid segregation occur during molding due to a non-uniform solid fraction in cross section, making it impossible to attain uniform mechanical properties.

These problems are solved by allowing a cooling gas or water to flow through the third and fourth inflow/outflow holes 132 and 151 to primarily cool the extrudate 210 during extrusion molding and prevent an increase in the surface temperature of the extrudate 210.

In step S5, a cooling gas is sprayed from the cooling unit 170 to secondarily cool the solid extrudate 210 primarily cooled in the extrusion die body 140. This sequential cooling prevents the formation of coarse solid particles in the solid extrudate 210. Herein, the solid extrudate 210 is extrusion-molded into a bar.

Figure 8:
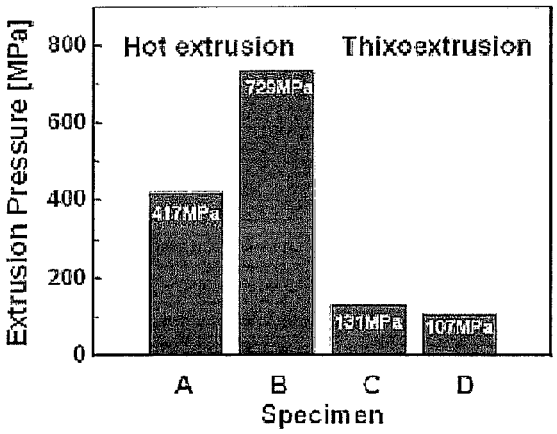
FIG. 8 is a graph comparing the maximum extrusion pressures in the production of aluminum alloy extrudates in accordance with a method of the present invention and a prior art method.

FIG. 8 is a graph comparing the maximum extrusion pressures in the production of aluminum alloy extrudates in accordance with the method of the present invention and a prior art method.

In FIG. 8, 'A' represents the maximum extrusion pressure during hot extrusion of an A7003 aluminum alloy, 'B' represents the maximum extrusion pressure during hot extrusion of an A7075 aluminum alloy, 'C represents the maximum extrusion pressure during thixoextrusion of an A7003 aluminum alloy, and 'D' represents the maximum extrusion pressure during thixoextrusion of an A7075 aluminum alloy.

The hot extrusion is performed by forward extrusion in an 800-ton horizontal type hot extrusion apparatus to produce a high-strength aluminum alloy part. The hot extrusion and the thixoextrusion are performed at an extrusion ratio of 11.

The maximum extrusion pressure during thixoextrusion of the A7003 aluminum alloy is 131 MPa, which is about 69% lower than that (417 MPa) during hot extrusion of the A7003 aluminum alloy. The maximum extrusion pressure during thixoextrusion of the A7075 aluminum alloy is 107 MPa, which is about 85% lower than that (729 MPa) during hot extrusion of the A7075 aluminum alloy.

Figure 9:
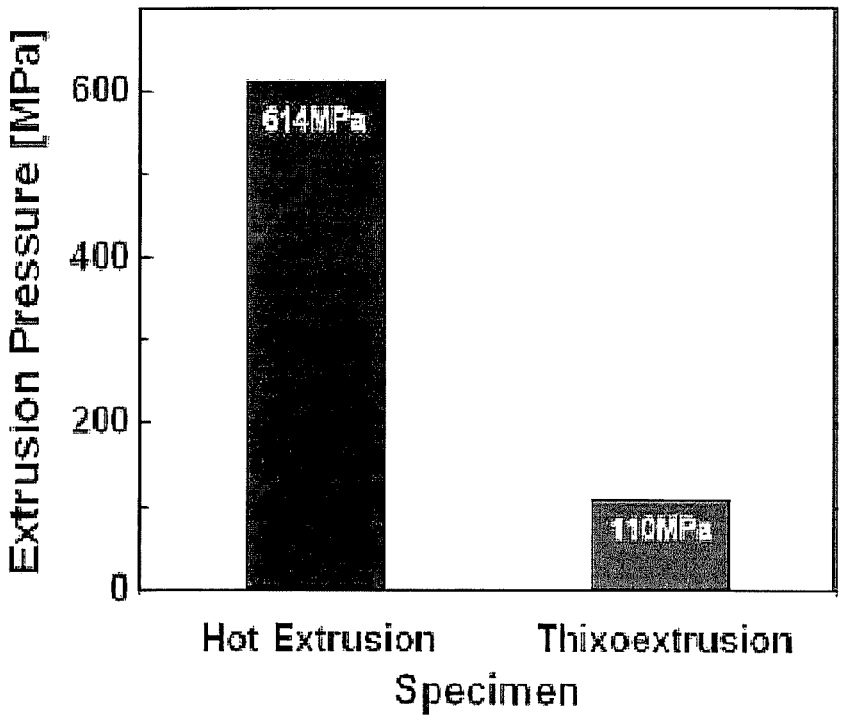
FIG. 9 is a graph comparing the maximum extrusion pressures in the production of aluminum alloy extrudates in accordance with a method of the present invention and a prior art method.

FIG. 9 is a graph comparing the maximum extrusion pressures in the production of aluminum alloy extrudates in accordance with the method of the present invention and a prior art method. Specifically, FIG. 9 shows the maximum extrusion pressures of AZ31 magnesium alloys during hot extrusion and thixoextrusion.

As shown in FIG. 9, the maximum extrusion pressure during thixoextrusion of the AZ31 magnesium alloy is 110 MPa, which is about 82% lower than that (614 MPa) during hot extrusion of the AZ31 magnesium alloy.

Figure 10:
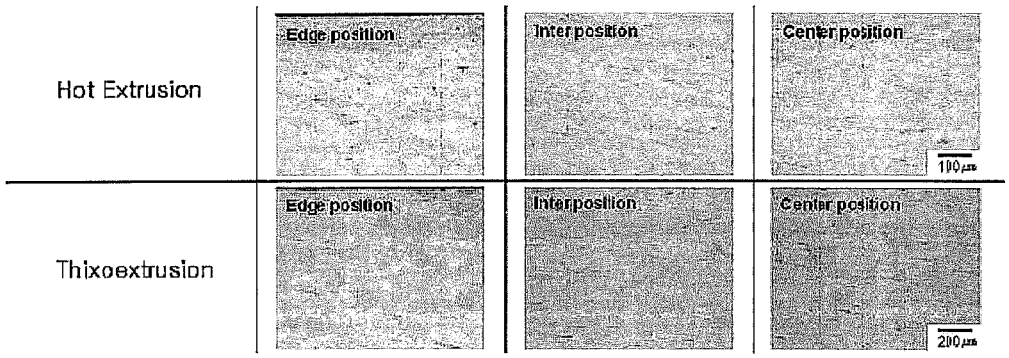
FIG. 10 shows images of cross-sectional structures of aluminum alloy extrudates produced in accordance with a method of the present invention and a prior art method.

FIG. 10 shows images of cross-sectional structures of aluminum alloy extrudates produced in accordance with the method of the present invention and a prior art method. Specifically, FIG. 10 shows structures in different positions (edge, inter and center) in the cross sections parallel to the extrusion directions of A7003 aluminum alloy extrudates produced by thixoextrusion and hot extrusion.

Figure 11:
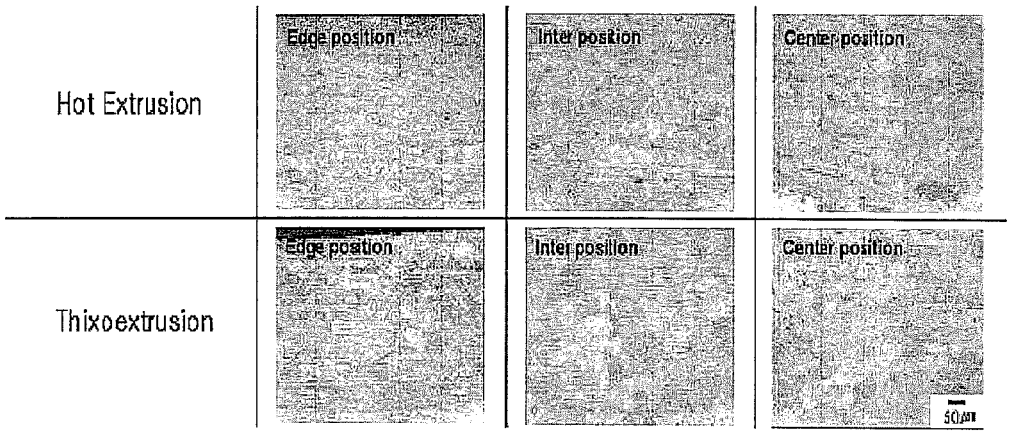
FIG. 11 shows images of cross-sectional structures of magnesium alloy extrudates produced in accordance with a method of the present invention and a prior art method.

FIG. 11 shows images of cross-sectional structures of magnesium alloy extrudates produced in accordance with the method of the present invention and a prior art method. Specifically, FIG. 11 shows structures in different positions (edge, inter and center) in the cross sections parallel to the extrusion directions of AZ31 magnesium alloy extrudates produced by thixoextrusion and hot extrusion.

As shown in FIGS. 10 and 11, elongation and typical anisotropy of grains in the extrusion directions are observed in the extrudates produced by hot extrusion. These phenomena cause differences in the mechanical properties of the extrudates in the extrusion direction and the direction perpendicular thereto, indicating that the extrudates have non-uniform mechanical properties as a whole.

In contrast, no elongation and axial symmetry of grains are observed in the extrudates produced by thixoextrusion molding.

Therefore, according to the thixoextrusion molding apparatus and method of the present invention, elongation and anisotropy of grains of the extrudates in the extrusion directions are controlled to achieve high strength of the extrudates.

Figure 12:
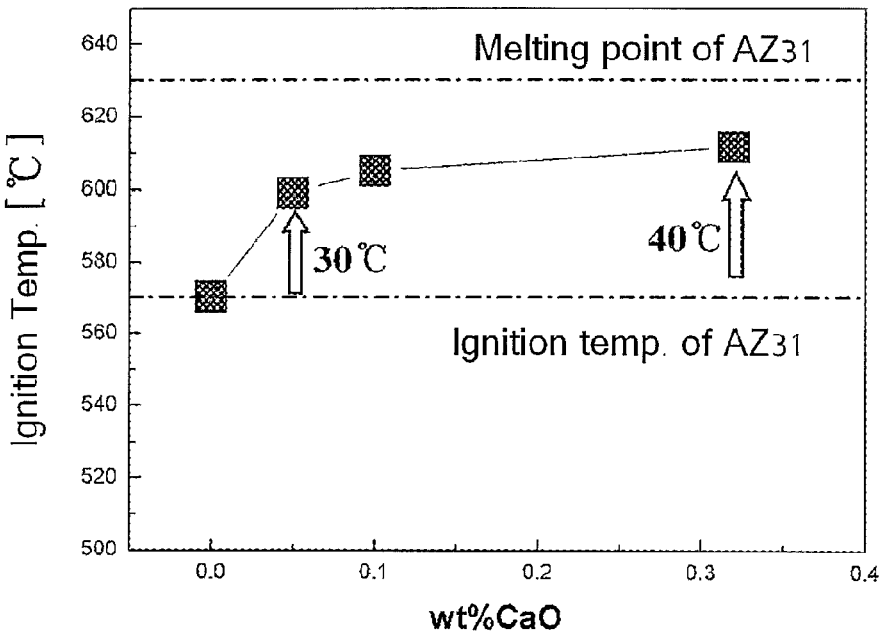
FIG. 12 is a graph showing the ignition temperatures of additive-containing magnesium alloys added to the apparatus of FIG. 1 under an ambient atmosphere.

FIG. 12 is a graph showing the ignition temperatures of additive-containing magnesium alloys added to the thixoextrusion molding apparatus under an ambient atmosphere. Specifically, FIG. 12 shows the ignition temperatures of AZ31 magnesium alloys containing calcium oxide (CaO) as an additive under an ambient atmosphere.

The AZ31 magnesium alloy containing no calcium oxide (CaO) begins to ignite at 570° C., which is lower than the temperature (590-650° C.) of the solid-liquid coexisting region, during thixoextrusion. Hence, a large amount of a protective gas is necessary to prevent the AZ31 magnesium alloy containing no calcium oxide (CaO) from being ignited during thixoextrusion.

In contrast, the presence of calcium oxide (CaO) as an additive increases the ignition temperatures of the AZ31 magnesium alloys under an ambient atmosphere. For example, the ignition temperatures of the AZ31 magnesium alloy containing 0.05 wt % and 0.3 wt % of calcium oxide are about 30° C. and 40° C., respectively, higher than the ignition temperature of the AZ31 magnesium alloy containing no additive under an ambient atmosphere. In conclusion, the presence of calcium oxide (CaO) in the AZ31 magnesium alloys greatly increases the ignition temperatures of the alloys to reduce the amount of a protective gas used or eliminate the need for the use of any protective gas.

Although calcium oxide has been exemplified herein as an additive, it is to be understood that the above-mentioned additives can be used without limitation.

Figure 13:
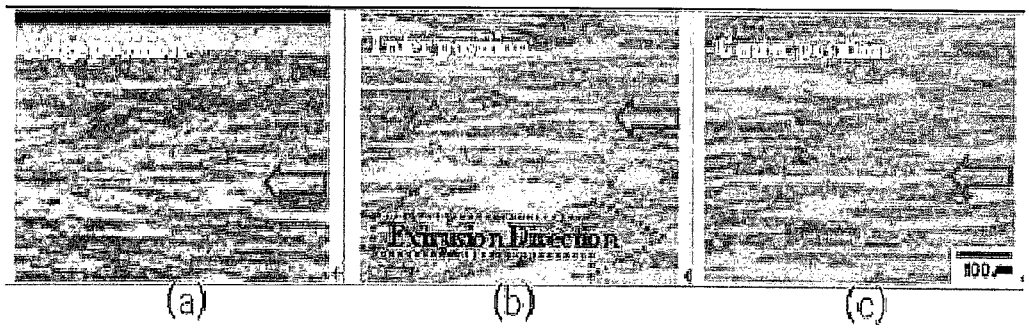
FIG. 13 shows images of the structure of a magnesium alloy extrudate produced by hot extrusion.
Figure 14:
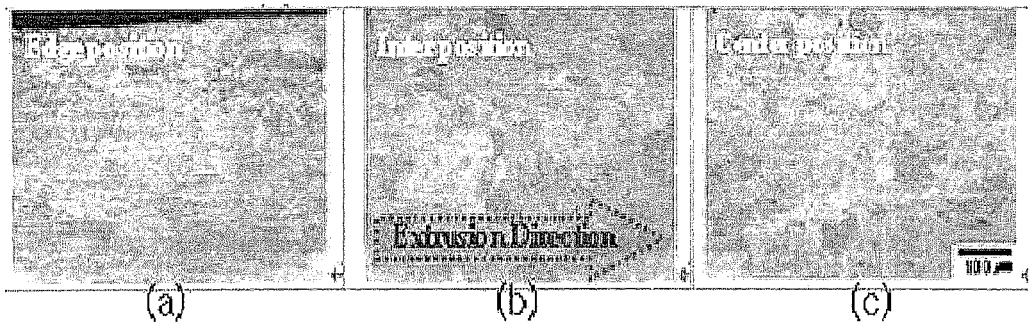
FIG. 14 shows images of the structure of a magnesium alloy extrudate produced by thixoextrusion molding in accordance with the present invention.
Figure 15:
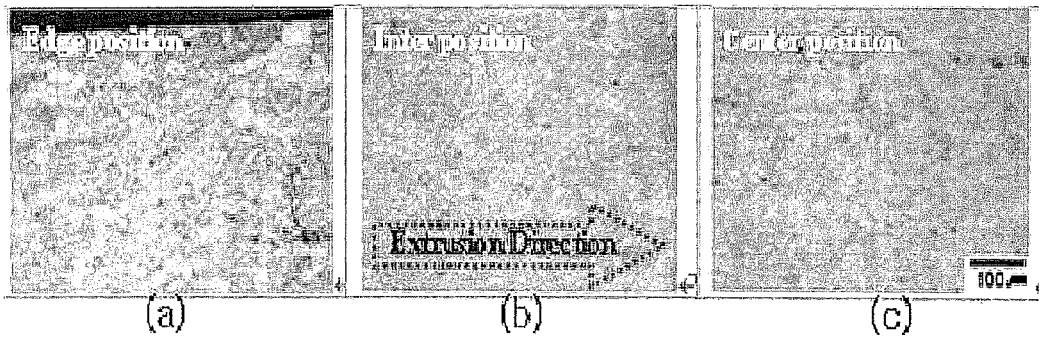
FIG. 15 shows images of the structure of an additive-containing magnesium alloy extrudate produced by thixoextrusion molding.

FIG. 13 shows images of the structure of a magnesium alloy extrudate produced by hot extrusion, FIG. 14 shows images of the structure of a magnesium alloy extrudate produced by thixoextrusion molding in accordance with the present invention, and FIG. 15 shows images of the structure of an additive-containing magnesium alloy extrudate produced by thixoextrusion molding.

Specifically, FIGS. 13, 14 and 15 show cross-sectional microstructures of a magnesium alloy extrudate produced by hot extrusion, a magnesium alloy extrudate produced by thixoextrusion molding, and a magnesium alloy extrudate containing 0.001-30 wt % of calcium oxide (CaO) produced by thixoextrusion molding.

In FIG. 13, (a), (b) and (c) represent edge, inter and center positions of the extrudate, respectively. As shown in FIG. 13, the extrudate has elongated grains whose structure is anisotropic in the extrusion direction in the different positions. The elongation of the grains causes differences in the mechanical properties of the extrudate in the extrusion direction and the direction perpendicular thereto, indicating that the extrudate has non-uniform mechanical properties as a whole.

In contrast, each of the magnesium alloy produced by thixoextrusion (FIG. 14) and the magnesium alloy containing 0.001-30 wt % of CaO produced by thixoextrusion (FIG. 15) has an isotropic grain microstructure in the center (a), inter (b) and edge (c) positions. This structure improves the strength of the extrudates.

Particularly, the structure of the magnesium alloy containing 0.001-30 wt % of calcium oxide (CaO) (FIG. 15) is finer than that of the magnesium alloy of FIG. 14. Calcium present in the calcium oxide (CaO) reacts with the magnesium alloy to create a stable MgCa or $Mg_2Ca$ compound, which stabilizes the microstructure of the alloy and achieves grain refinement of the alloy.

Figure 16:
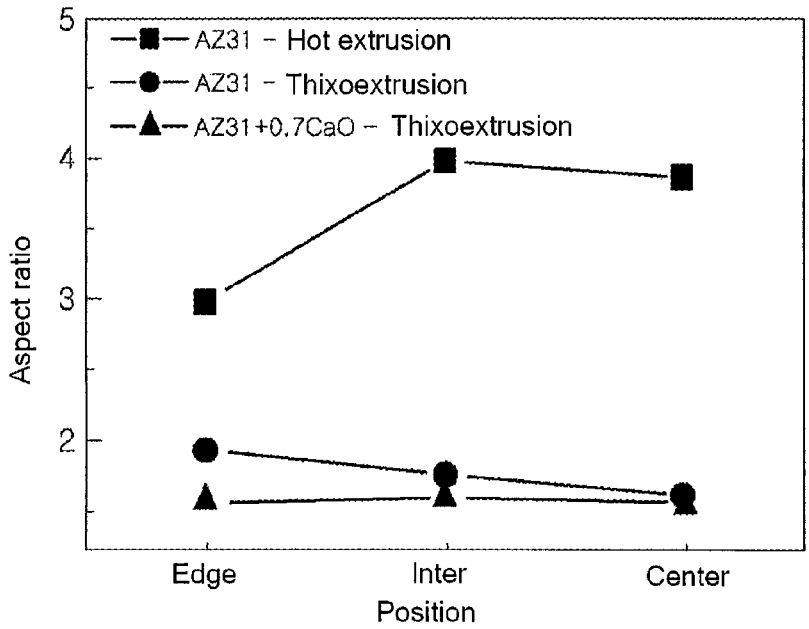
FIG. 16 is a graph showing the aspect ratios of grains present in the cross sections of the extrudates shown in FIGS. 13, 14 and 15.

FIG. 16 is a graph showing the aspect ratios of grains present in the cross sections of the extrudates shown in FIGS. 13, 14 and 15.

The aspect ratio is defined as the ratio of the major and minor axes, as measured using an image analysis system. The aspect ratios of the extrudate produced by hot extrusion (FIG. 13) in the center, inter and edge positions fluctuate between about 3 and about 4.

In contrast, the aspect ratios of the extrudates produced by thixoextrusion (FIGS. 14 and 15) are controlled to 2 or less. Particularly, the aspect ratios of the magnesium bar containing 0.001 to 30 wt % of calcium oxide (CaO) produced by thixoextrusion (FIG. 15) in the center, inter and edge positions are substantially uniform (~1.5). That is, the magnesium bar of FIG. 15 has an isotropic microstructure. Therefore, the presence of calcium oxide in the magnesium bar enables the use of a protective gas in a reduced amount or eliminates the need for the use of any protective gas.

Figure 17:
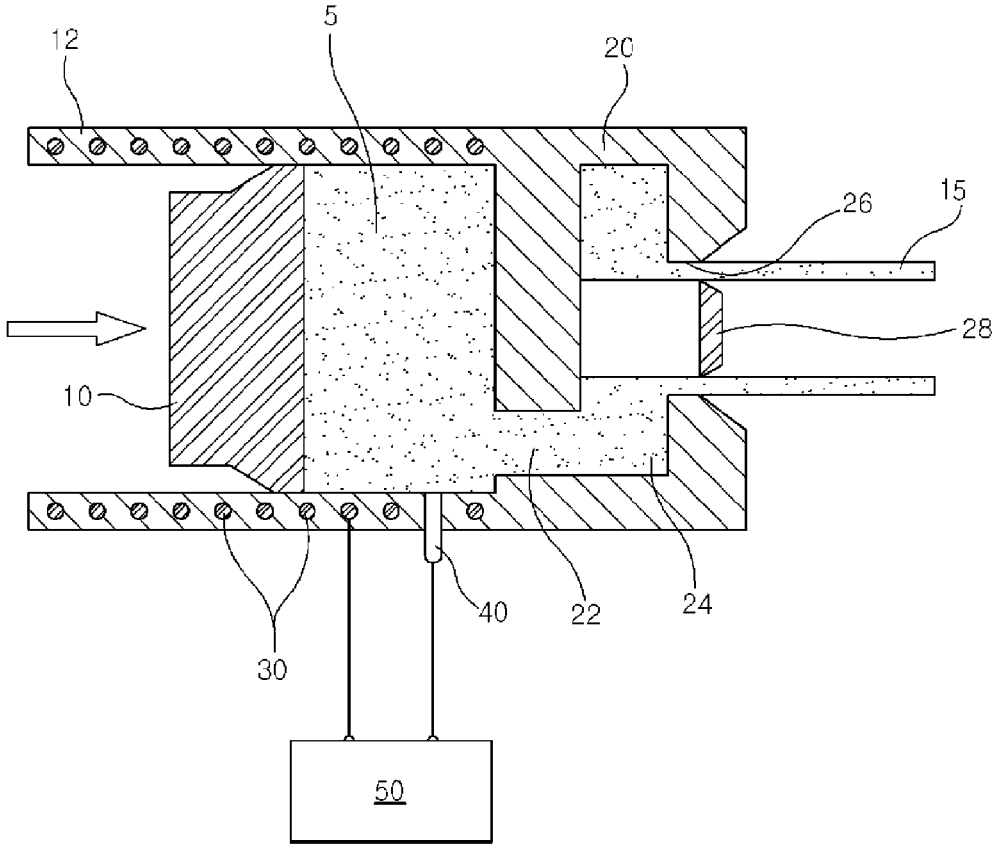
FIG. 17 is a cross-sectional view illustrating a thixoextrusion molding apparatus according to another embodiment of the present invention.

FIG. 17 is a cross-sectional view illustrating a thixoextrusion molding apparatus according to another embodiment of the present invention.

As illustrated in FIG. 17, the thixoextrusion molding apparatus comprises a container 12 in which an extrusion billet 5 in a semi-solid state is stored. The semisolid extrusion billet 5 is pressurized inside the container 12 to pass through an extrusion die 20.

The extrusion die 20 has a plurality of extrusion holes 22 through which the billet 5 pressurized inside the container 12 is split and extruded into a plurality of strands, a chamber 24 accommodating the billet 5 passing through the extrusion holes 22, a bearing 26 being in communication with the chamber 24 to form the outer circumference of an extrudate 15 in the form of a tube, and a mandrel 28 positioned at the center of the bearing 26 to form the inner circumference of the extrudate 15.

A heater 30 is buried in the container 12 and is coiled to heat the billet stored in the container 12 and maintain the billet in a semi-solid state. The internal temperature of the container 12 is increased by heat from the heater 30 to maintain the billet in a semi-solid state.

The temperature of the billet heated by the heater 30 inside the container 12 is detected by a temperature sensor 40. The temperature sensor 40 may be installed at a stem 10 or the container 12.

A control unit 50 is installed to compare the temperature (T) detected by the temperature sensor 40 with a preset temperature ($T_0$) to control the on/off operation of the heater 30. The control unit 50 is electrically connected to the temperature sensor 40 and the heater 30.

Figure 18:
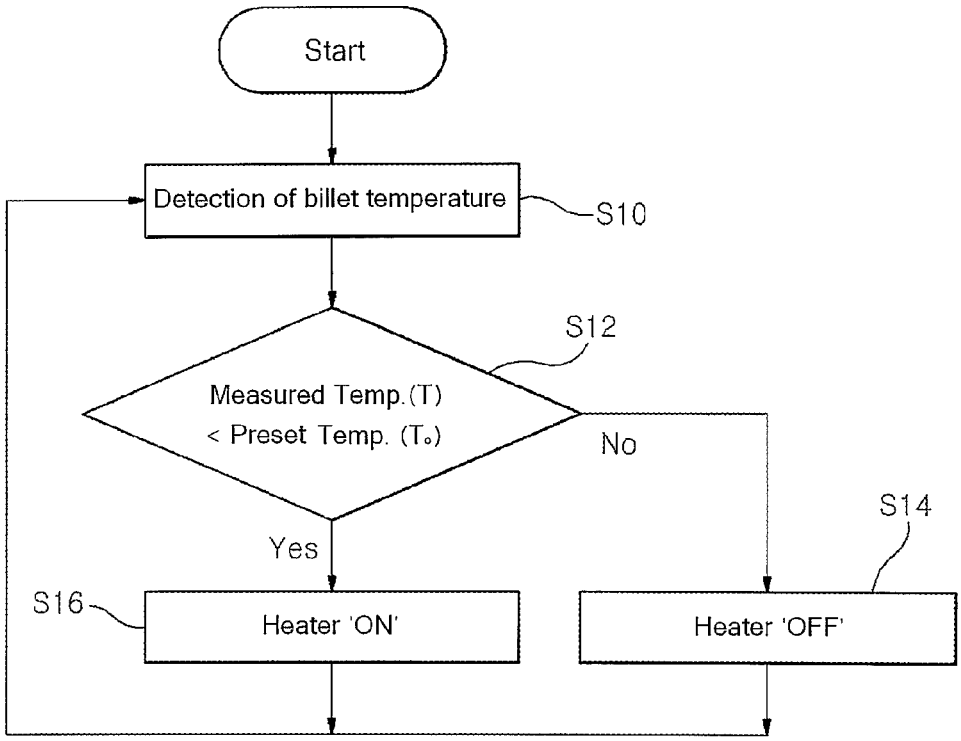
FIG. 18 is a flow chart illustrating a procedure for maintaining the temperature of a billet constant in the thixoextrusion molding apparatus of FIG. 17.

FIG. 18 is a flow chart illustrating a procedure for maintaining the temperature of the billet constant in the thixoextrusion molding apparatus.

First, the temperature of the extrusion billet 5 is detected by the temperature sensor 40 (S1). In this step, it is preferred that the billet 5 is in a semisolid state before being fed into the container 12. The semi-solid state refers to an intermediate state of solid and liquid phases.

The temperature (T) of the billet detected by the temperature sensor 40 is sent to the control unit 50, where the temperature (T) is compared with the set temperature ($T_0$) (S12).

If the temperature (T) is higher than the set temperature ($T_0$), then the control unit 50 turns the heater 30 'OFF' to prevent the billet from being changed to a solid phase (S14).

This operation of the control unit 50 allows the billet to be extruded in a semi-solid state. As a result, the split strands of the billet escaping from the extrusion holes 22 pass through the bearing 26 and the mandrel 28 and are again fused in a semi-solid state, leaving no welding lines.

When the billet is aluminum and the thixoextrusion temperature is maintained at 630-650° C., a seamless extrudate in the form of a tube is produced without leaving any welding line.

Figure 19:
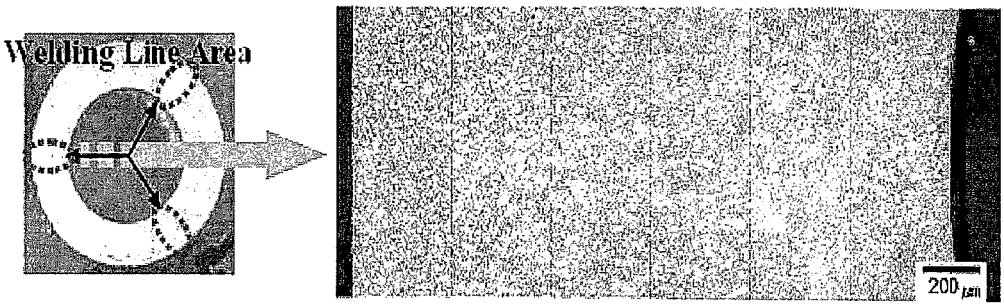
FIG. 19 shows micrographs of welding line areas of a tube produced using the apparatus of FIG. 17.

FIG. 19 shows micrographs of welding line areas of a tube produced using the apparatus of FIG. 17 in accordance with the procedure of FIG. 18.

As shown in FIG. 19, no welding line is observed, which suggests that the tube can be prevented from being destroyed during pressure resistance testing or expansion. It should be understood that the present invention is applicable to Ag, Cu, Al, Mg and Ti for seamless tubes, as well as aluminum.

The mechanical properties of products using the seamless extrudate (tube) produced by the method of the present invention are uniform, which increases the degree of freedom in the design of the products. In addition, better characteristics can be obtained even in general mechanical structures (architectures) suffering pressurization, expansion and bending. Furthermore, reduction in weight and thickness can be achieved, thus eliminating the need to make seam portions thicker. Moreover, profiles having complex shapes can be produced, compared to conventional simple seamless extrusion.

Although the foregoing embodiments have been described to practice the thixoextrusion molding apparatuses and methods of the present invention, these embodiments are set forth for illustrative purposes and do not serve to limit the invention. Those skilled in the art will readily appreciate that many modifications and variations can be made, without departing from the spirit and scope of the invention as defined in the appended claims, and such modifications and variations are encompassed within the scope and spirit of the present invention.

The invention claimed is:

1. A thixoextrusion molding apparatus, comprising:

a container having a first through-hole storing 10 to 30 parts weight of a semi-solid billet therein and a heater installed outside the first through-hole to maintain the temperature of the semi-billet constant;

a stem insertable into the first through-hole from the front of the container to pressurize the semi-solid billet in the backward direction;

a die ring coupled to the back of the container and having a plurality of coolant inflow/outflow holes to prevent thermal deformation in the circumferential direction;

a die body disposed inside the die ring and having a second through-hole, which is in communication with the first through-hole of the container and has a smaller diameter than the first through-hole of the container, through which the semi-solid billet is extruded and a plurality of thermocouple insertion holes for measuring the temperature of the semi-solid billet;

a die body support coupled to the back of the die body inside the die ring and having a plurality of coolant inflow/outflow holes so as to change the phase of the extruded semi-solid billet to a solid extrudate;

a die balance support held in close contact with the die body support and coupled to the back of the die ring; and a cooling unit coupled to the die balance support to cool the solid extrudate.

2. The apparatus according to claim 1, wherein the thermocouple insertion holes include a first thermocouple insertion hole for measuring the temperature of the die body and a second thermocouple insertion hole for measuring the temperature of the semi-solid billet.

3. The apparatus according to claim 1, wherein the semi-solid billet is selected from aluminum alloys and magnesium alloys.

4. The apparatus according to claim 1, wherein the semi-solid billet is a magnesium alloy containing at least one additive.

5. The apparatus according to claim 4, wherein the additive is selected from alkali metals, alkali metal oxides, alkali metal compounds, alkaline earth metals, alkaline earth metal oxides, alkaline earth metal compounds, and mixtures thereof.

6. The apparatus according to claim 4, wherein the additive is present in an amount of 0.0001 to 30 parts by weight, based on 100 parts by weight of the magnesium alloy.

7. The apparatus according to claim 1, wherein the semi-solid billet is maintained at a temperature of 590 to 650° C. by the heater of the container.

8. A thixoextrusion molding method using the apparatus according to claim 1, the method comprising:

maintaining 10 to 30 parts by weight of a semi-solid billet in the container at a constant temperature;

maintaining the temperature of the die body constant;

extrusion-molding the semi-solid billet into a solid extrudate under pressure in the die body; and cooling the solid extrudate.

9. The method according to claim 8, wherein the semi-solid billet is selected from aluminum alloys and magnesium alloys.

10. The method according to claim 8, wherein the semi-solid billet is a magnesium alloy containing at least one additive.

11. The method according to claim 10, wherein the additive is selected from alkali metals, alkali metal oxides, alkali metal compounds, alkaline earth metals, alkaline earth metal oxides, alkaline earth metal compounds, and mixtures thereof.

12. The method according to claim 8, wherein the additive is present in an amount of 0.0001 to 30 parts by weight, based on 100 parts by weight of the magnesium alloy.

13. The method according to claim 8, wherein the semi-solid billet is maintained at a temperature of 590 to 650° C. by the heater of the container.

14. A thixoextrusion molding apparatus, comprising:

a container having a first through-hole storing a semi-solid billet and a heater embedded in the container;

a stem insertable into the first through-hole to pressurize the semi-solid billet;

a die ring coupled to the back of the container and having a plurality of coolant inflow/outflow holes;

a die body disposed inside the die ring and having a second through-hole, which is in communication with the first through-hole of the container and has a smaller diameter than the first through-hole of the container, through which the semi-solid billet is extruded and a plurality of thermocouple insertion holes;

a die body support coupled to the back of the die body inside the die ring and having a plurality of coolant inflow/outflow holes;

a die balance support held in close contact with the die body support and coupled to the back of the die ring; and a cooling unit coupled to the die balance support.

15. The apparatus according to claim 14, wherein the thermocouple insertion holes include a first thermocouple insertion hole for measuring the temperature of the die body and a second thermocouple insertion hole for measuring the temperature of the semi-solid billet.

16. The apparatus according to claim 14, wherein the semi-solid billet is selected from aluminum alloys and magnesium alloys.

17. The apparatus according to claim 14, wherein the semi-solid billet is a magnesium alloy containing at least one additive.

18. The apparatus according to claim 17, wherein the additive is selected from alkali metals, alkali metal oxides, alkali metal compounds, alkaline earth metals, alkaline earth metal oxides, alkaline earth metal compounds, and mixtures thereof.

19. The apparatus according to claim 17, wherein the additive is present in an amount of 0.0001 to 30 parts by weight, based on 100 parts by weight of the magnesium alloy.

20. The apparatus according to claim 14, wherein the semi-solid billet is maintained at a temperature of 590 to 650° C. by the heater of the container.

* * * * *